US009782043B2

(12) United States Patent
Longman

(10) Patent No.: US 9,782,043 B2
(45) Date of Patent: Oct. 10, 2017

(54) BATHTUB HAVING SLIDING ACCESS DOOR FOR THE DISABLED AND ELDERLY

(75) Inventor: Matthew James Longman, Kelowna (CA)

(73) Assignee: 0649072 BC Ltd., Kelowne, British Columbia (CA)

( * ) Notice: Subject to any disclaimer, the term of this patent is extended or adjusted under 35 U.S.C. 154(b) by 1194 days.

(21) Appl. No.: 11/604,808

(22) Filed: Nov. 28, 2006

(65) Prior Publication Data

US 2007/0067901 A1 Mar. 29, 2007

Related U.S. Application Data

(63) Continuation-in-part of application No. 10/500,133, filed as application No. PCT/CA03/00015 on Jan. 10, 2003, now Pat. No. 7,237,276.

(60) Provisional application No. 60/346,883, filed on Jan. 11, 2002.

(51) Int. Cl.
*A47K 3/00* (2006.01)

(52) U.S. Cl.
CPC ..... *A47K 3/006* (2013.01)

(58) Field of Classification Search
CPC ..... A47K 3/006
USPC ..... 4/555, 556; 49/213, 214, 496.1
See application file for complete search history.

(56) References Cited

U.S. PATENT DOCUMENTS

| | | | | |
|---|---|---|---|---|
| 540,979 | A * | 6/1895 | Hardin | 49/214 |
| 2,740,168 | A | 5/1956 | Wright | |
| 3,312,015 | A * | 4/1967 | Plegat | 49/213 |
| 3,423,769 | A * | 1/1969 | Cowley | 4/556 |
| 3,602,405 | A | 8/1971 | Ames | |
| 4,063,389 | A | 12/1977 | Leder | |
| 4,360,935 | A | 11/1982 | Barrett, Sr. | |
| 4,365,367 | A | 12/1982 | Houle et al. | |
| 4,957,301 | A * | 9/1990 | Clay et al. | 49/495.1 X |
| 6,442,900 | B1 | 9/2002 | Kvasnes | |
| 6,497,072 | B2 | 12/2002 | Fries | |
| 6,871,448 | B1 | 3/2005 | Kline | |
| 2002/0017060 | A1 | 2/2002 | Kern et al. | |
| 2003/0182866 | A1 | 10/2003 | Nestell et al. | |

(Continued)

FOREIGN PATENT DOCUMENTS

| | | |
|---|---|---|
| CA | 1 089 713 | 11/1980 |
| EP | 0 700 655 A1 | 3/1996 |

(Continued)

OTHER PUBLICATIONS

English language abstract of EP 0913115, May 1999, 2 pgs.*
English language abstract of WO 9318261, Sep. 1993, 2 pgs.*

*Primary Examiner* — Janie Loeppke
(74) *Attorney, Agent, or Firm* — Antony C. Edwards

(57) ABSTRACT

A bathtub has a doorway in a sidewall thereof. A door is slidably mounted to guides on guide followers mounted to both the door and the guides. The guide followers carry the door along a substantially horizontal translation along the sidewall between open and closed positions. A releasable latch and cooperating latch actuator is mounted to the door for releasable latching engagement of the door when in a watertight sealed engagement in the doorway, and for releasing the door from such engagement upon actuation by a user of the latch actuator into its release position. A passive hydrostatic seal is mounted so as to be sandwiched between the door and the doorway doorframe when the door is closed.

10 Claims, 10 Drawing Sheets

(56) References Cited

U.S. PATENT DOCUMENTS

| | | | |
|---|---|---|---|
| 2004/0134131 | A1 | 7/2004 | Galer |
| 2005/0044620 | A1 | 3/2005 | Metcalf |
| 2005/0160677 | A1 | 7/2005 | Gepfrey et al. |

FOREIGN PATENT DOCUMENTS

| | | |
|---|---|---|
| EP | 1 400 653 | 3/2004 |
| GB | 471221 | 8/1937 |
| GB | 589368 | 6/1947 |
| GB | 1 065 319 | 4/1967 |
| GB | 1124740 | 7/1967 |
| GB | 1135196 | 4/1968 |
| GB | 1 213 358 | 11/1970 |
| GB | 2 017 796 | 10/1979 |
| GB | 2 075 100 | 11/1981 |
| GB | 2 334 438 | 8/1999 |

* cited by examiner

BATHTUB HAVING SLIDING ACCESS DOOR FOR THE DISABLED AND ELDERLY

CROSS REFERENCE TO RELATED APPLICATION

This application is a Continuation-in-Part patent Application of U.S. patent application Ser. No. 10/500,133 filed Jun. 25, 2004, which is a National Phase Entry from PCT Application No. PCT/CA03/00015 filed Jan. 10, 2003, which claims priority from U.S. Provisional Patent Application No. 60/346,883 filed Jan. 11, 2002.

FIELD OF THE INVENTION

This invention relates to the field of bathtubs and in particular a bathtub having a door providing improved access for the disabled and elderly.

BACKGROUND OF THE INVENTION

It is well known that people with limited mobility such as disabled and elderly often require assistance to use a conventional bathtub in order to properly bathe because their limited mobility inhibits them from safely lowering themselves or lifting themselves out of a conventional bathtub.

To address such a need, applicant is aware of attempts in the prior art to provide bath enclosures with access doors. For example, applicant is aware of U.S. Pat. No. 3,423,769 which issued to Cowley for a Bath on Jan. 28, 1969, wherein Cowley discloses the use of a guillotine style door to provide access for infirm persons to a bathtub.

Applicant is also aware of United Kingdom Patent Specification No. 1,213,358 published Nov. 25, 1970 for The Improvements in or Relating to Baths of Preston which discloses use of a sliding door to close an aperture in a bath, where the door slides horizontally on a guide upon the operation of a double-acting hydraulic cylinder and piston.

Applicant is also aware of European Patent Application No. 0 913 115 which was published May 6, 1999 for The Bath With A Side Access Opening Equipped With A Watertight Flap of Landi et al. which discloses a bath equipped with either a door hinged horizontally or vertically or a horizontally or vertically sliding door.

Applicant is further aware of United Kingdom Patent Application No. 2 334 438 published Aug. 25, 1999 for The Circular Sliding Door For A Bathtub of Nailer which discloses the use of a bathtub having a circular sliding door. The door slides sideways in both directions and moves forward and backward on rollers mounted to top and bottom of the door. The rollers run on runners which are fixed to panels above and below the rollers, the roller wheels interlocking with the runners. Hydraulic actuators hold the door when closed against a door seal.

Further, applicant is aware of applicant's own published PCT application No. PCT/CA03/00015 and corresponding U.S. patent application Ser. No. 10/500,133 published Dec. 2, 2004, entitled Bathtub Having Sliding Access Door for the Disabled and Elderly.

SUMMARY OF THE INVENTION

In summary, the bathtub according to the present invention for the disabled or elderly may be characterized in one aspect as including a tub having an enclosure defined by at least one sidewall, whereby the sidewall has a doorway defined by a doorframe. The doorway provides access from an external side of the sidewall, external to the enclosure, into the enclosure. At least one generally horizontal elongate vertically spaced apart pair of elongate guides are formed in or mounted to the sidewall.

A door is slidably mounted to the guides on guide followers mounted to both the door and the guides. The guide followers carry the door along its substantially horizontal translation along the sidewall. The door may be thus translated between a closed position wherein the door is releasably lockably mounted in watertight sealed engagement within the doorway adjacent the doorframe, and an open position clear of the doorway and substantially parallel to the sidewall. A releasable latch and cooperating latch actuator is mounted to the door for releasable latching engagement of the door in its watertight sealed engagement in the doorframe, and for releasing the door from such engagement upon actuation by a user of the latch actuator into its release position.

A passive hydrostatic seal is mounted so as to be sandwiched between the door and the doorframe when the door is in its watertight sealed engagement in the doorframe. The seal is resilient and includes a resilient-walled concavity extending substantially around a circumference of the door and a corresponding circumference of the doorframe. The opening into the concavity is disposed so as to be oriented inwardly into the doorway. Thus when the door is in its closed position, water pressure from water in the enclosure bearing against the seal urges the concavity to resiliently deform and thereby increase its sealing against the doorframe and the door.

In a preferred embodiment the guides each have an arcuate path and the guide followers may be rollers mounted to the door. The rollers may be caster-style wheels or rollers (collectively herein rollers), that is rollers rotatably mounted for both rolling along the guides and for rotation about vertical axes of rotation so as to follow the arcuate paths of the guides.

The latch actuator may include at least one substantially horizontal first latch member, such as a cross bar, pivotally mounted to the door and cooperating with a substantially vertical second latch member, such as a locking bar, for vertical urging of the second latch member into latched engagement with a latch member female receiver such as a hole or aperture in the doorframe so as to releasably engage the door with an edge of the doorway upon closing of the door into its closed position. The first latch member may be a cross bar-style lever which at a first end is pivotally mounted to the door for reciprocating actuation of the lever by the user, and which at its opposite second end is pivotally mounted to the second latch member. In one embodiment the second latch member includes at least one latch drive arm, such as a pin, mounted to the door for reciprocating vertical sliding into and out of releasably latching engagement with the female receiver in the lower portion of the doorframe.

Thus in one embodiment, the lever is horizontal and the latch drive arm is a rigid vertical drive arm mounted at a lower end of the second latch member for the selective driving of a distal lowermost end of the arm into the female receiver. Advantageously, the lever is horizontally disposed across an upper portion of the door so as to extend from one lateral side of the door to an opposite lateral side of the door. This provides for ease of grasping of the cross bar by a user either outside or inside the tub and for ease of then pulling upwardly on the cross bar so as to unlatch the door. No downward pushing on the cross bar so as to latch the door is required as the latch is a gravity latch and thus automatic upon proper latch alignment.

The hydrostatic seal may be U-shaped so as to have a bottom portion extending along a lowermost portion of the doorframe and door when in its closed position, and so as to have upright portions extending contiguously upwardly from the bottom portion. The seal's concavity may be, in cross section, substantially V-shaped. The seal may be mounted to the door so as to only engage the doorframe as the door is finally closed. The seal has a free edge around a circumference thereof which may be reinforced with a bead therealong.

DETAILED DESCRIPTION OF EMBODIMENTS OF THE INVENTION

Figure 1:
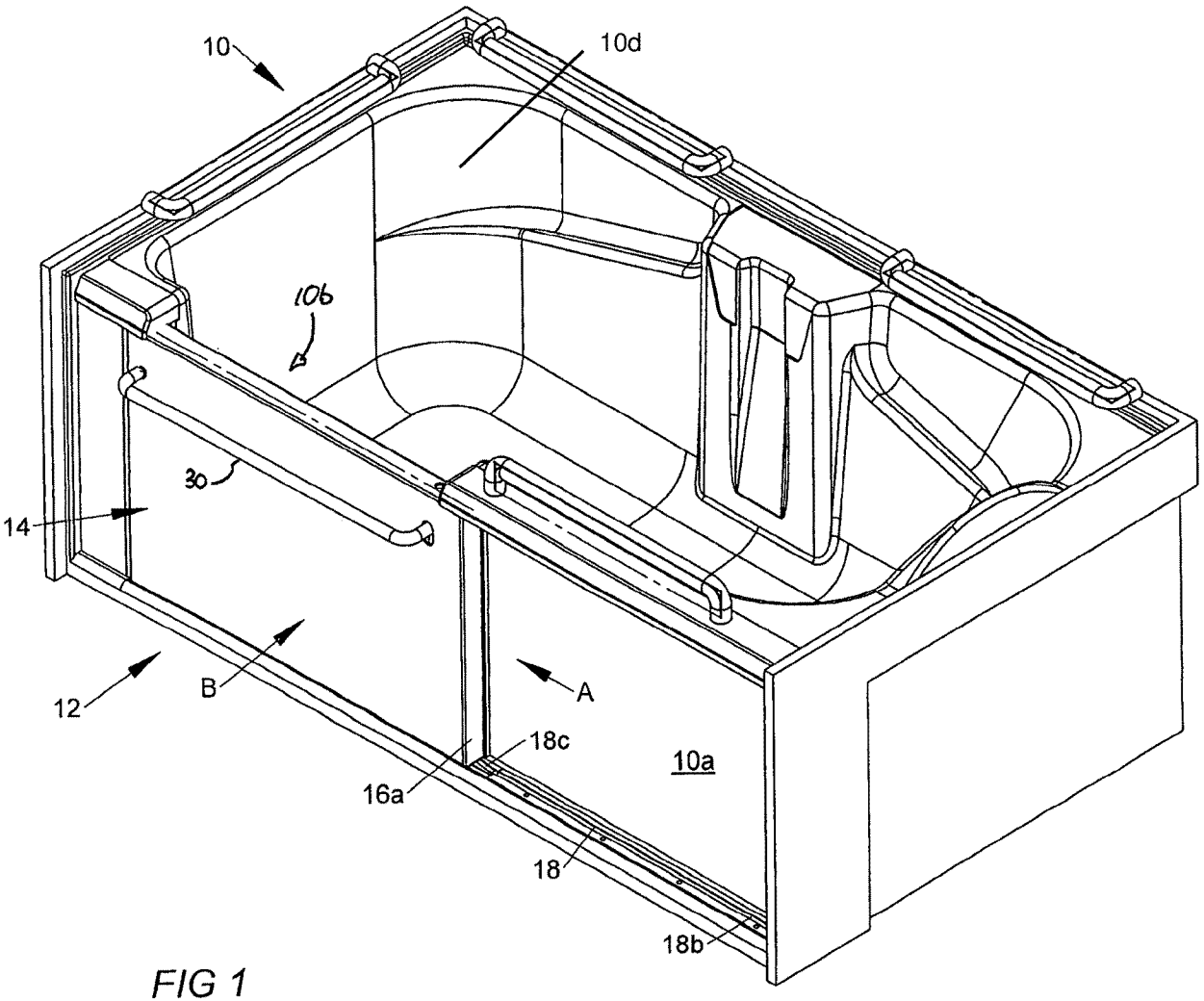
FIG. 1, is in front perspective view, a bathtub incorporating the door according to the present invention.
Figure 2B:
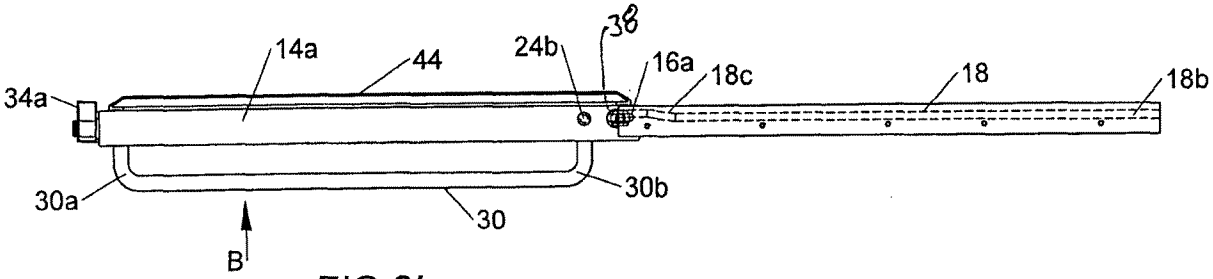
FIG. 2*b*, in plan view, the door of FIG. 2*a*.
Figure 2C:
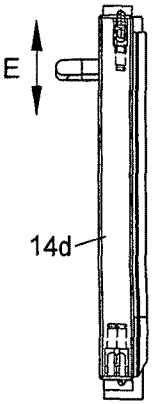
FIG. 2*c*, in right side elevation view, the door of FIG. 2*a*.
Figure 2A:
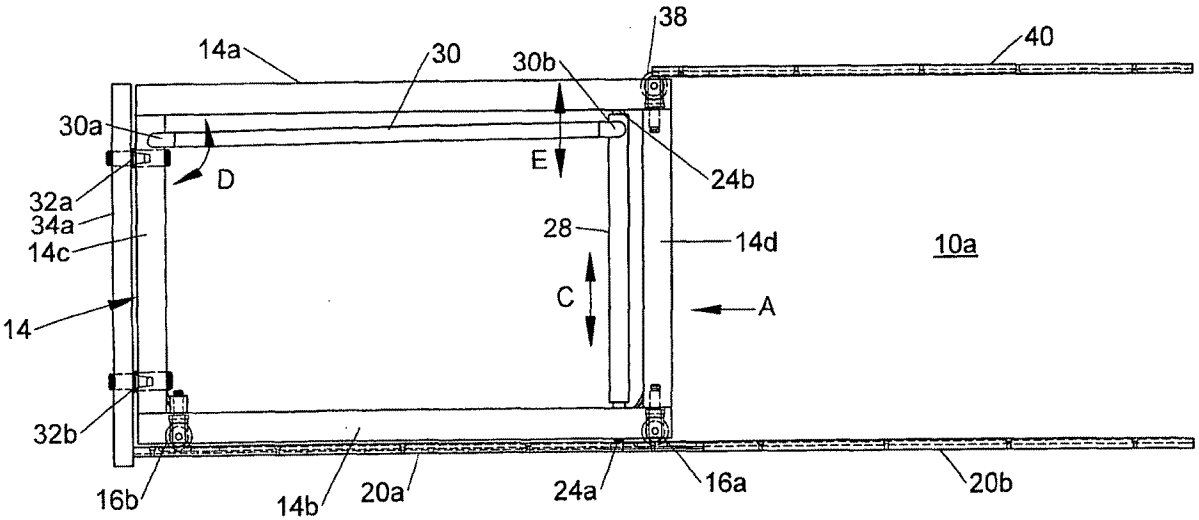
FIG. 2*a*, is front elevation view, the door of FIG. 1.
Figure 3:
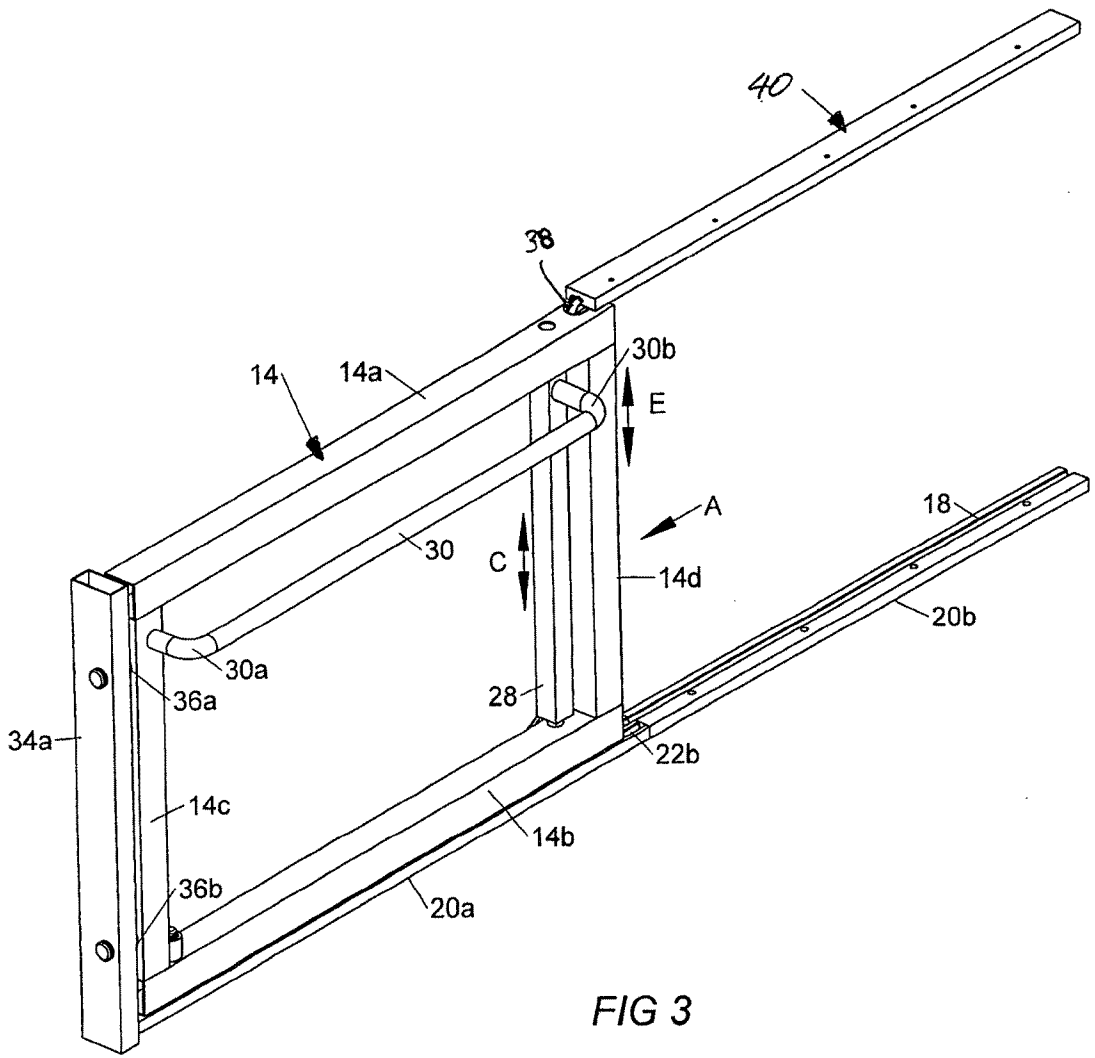
FIG. 3 is, in left side perspective view, the door of FIG. 2*a*.
Figure 4:
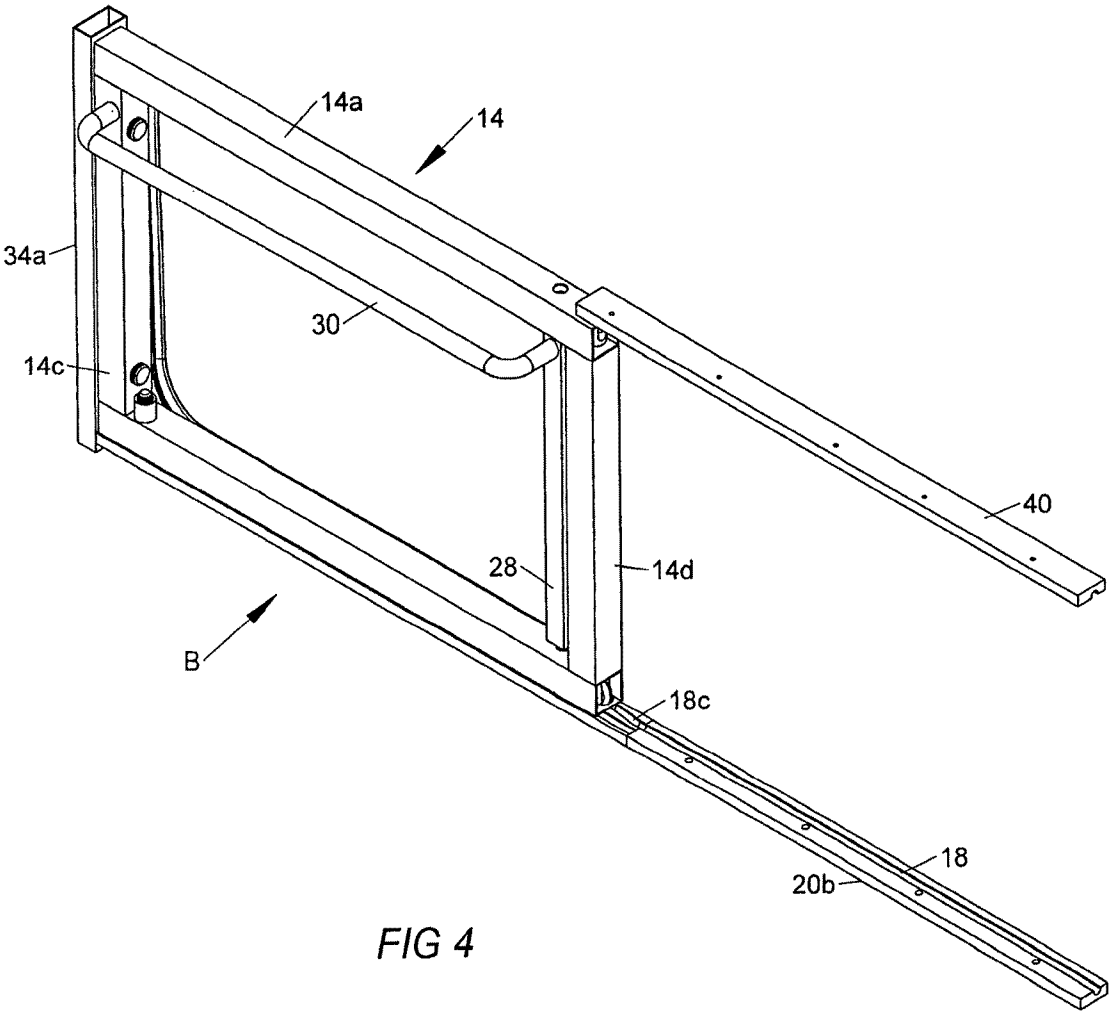
FIG. 4 is, in right side perspective view, the door of FIG. 2*a*.
Figure 5:
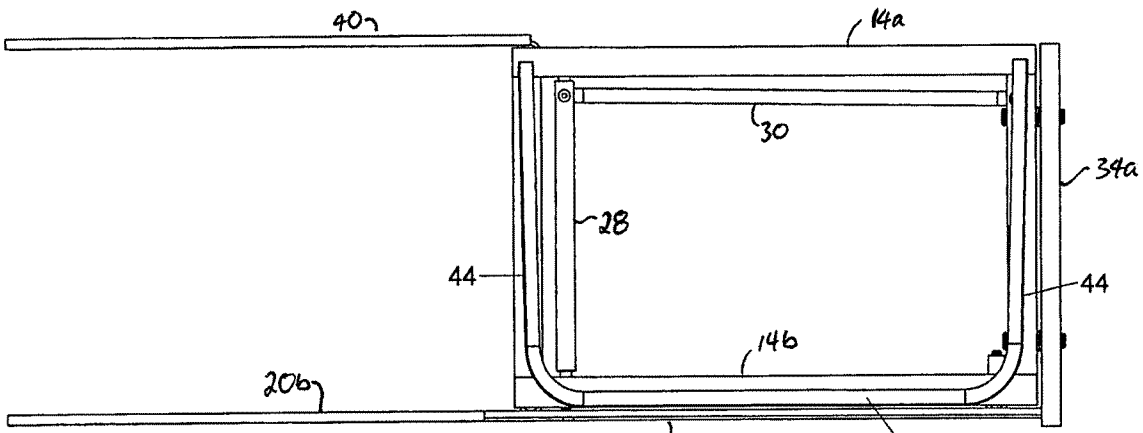
FIG. 5 is, in rear elevation view, the door of FIG. 2*a*.
Figure 4A:
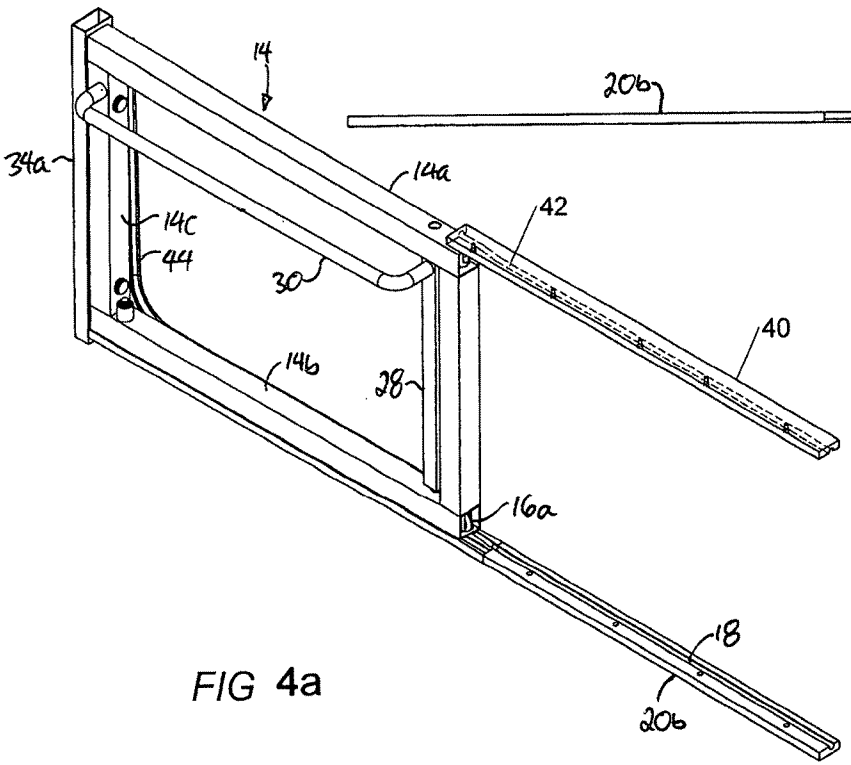
FIG. 4*a* is, in right side perspective view, the door of FIG. 4 partially cut away to show the upper guide track.
Figure 7:
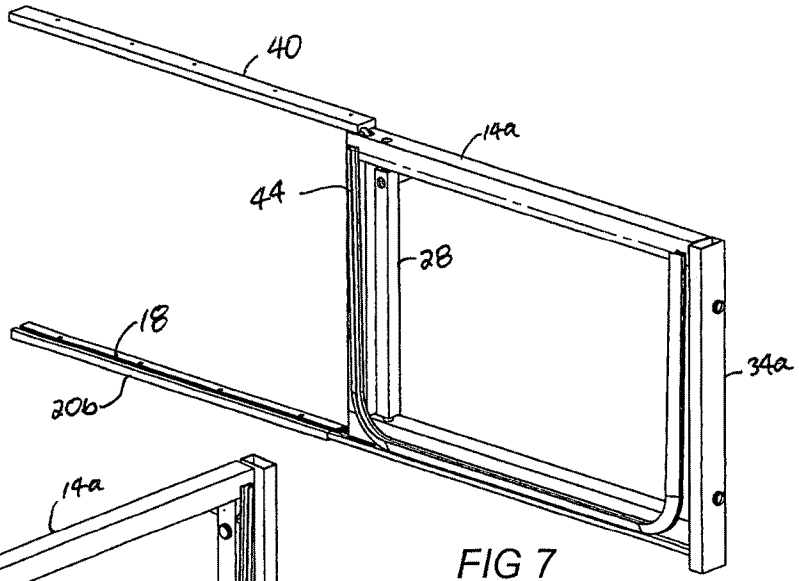
FIG. 7 is, in right rear perspective view, the door of FIG. 5.
Figure 6:
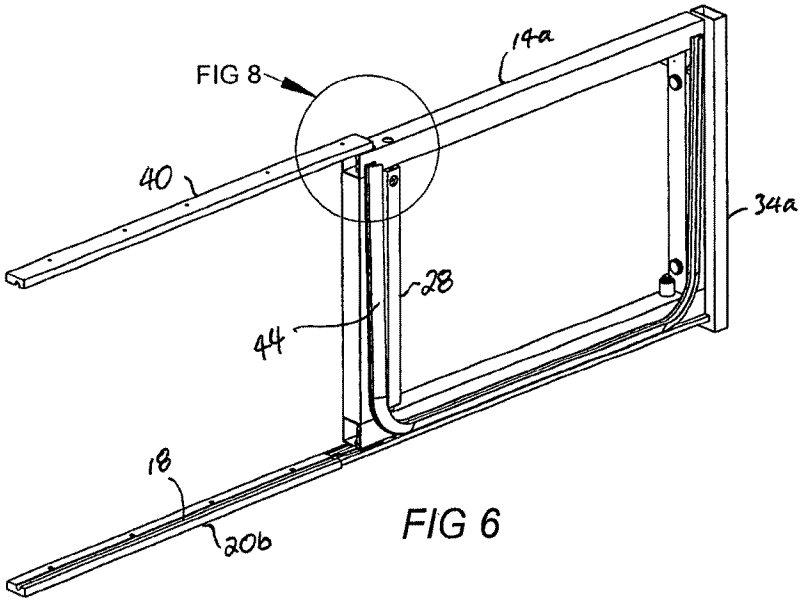
FIG. 6 is, in left side rear perspective view, the door of FIG. 5.
Figure 8:
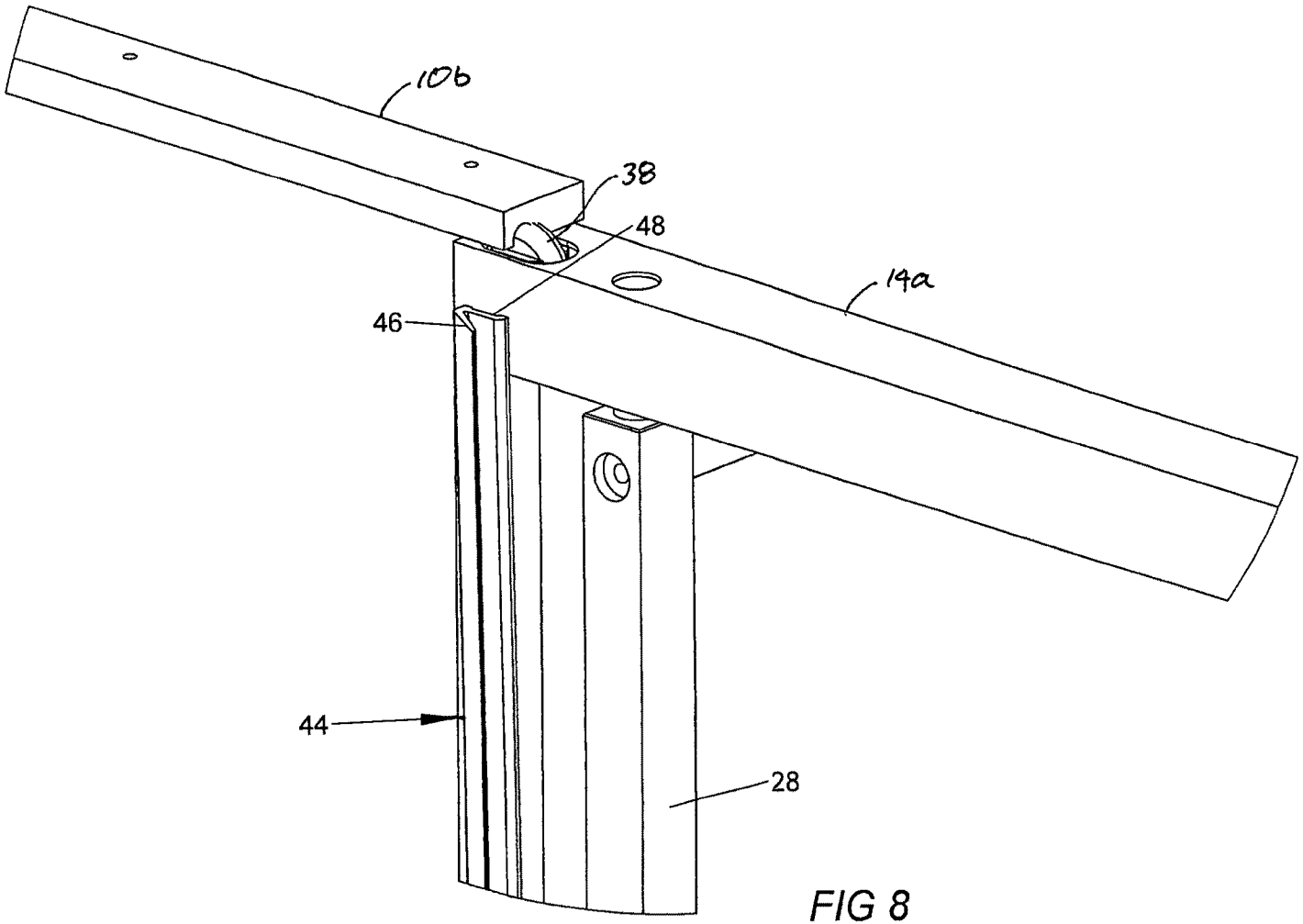
FIG. 8 is, in partially cut away enlarged view, the door of FIG. 6.
Figure 9:
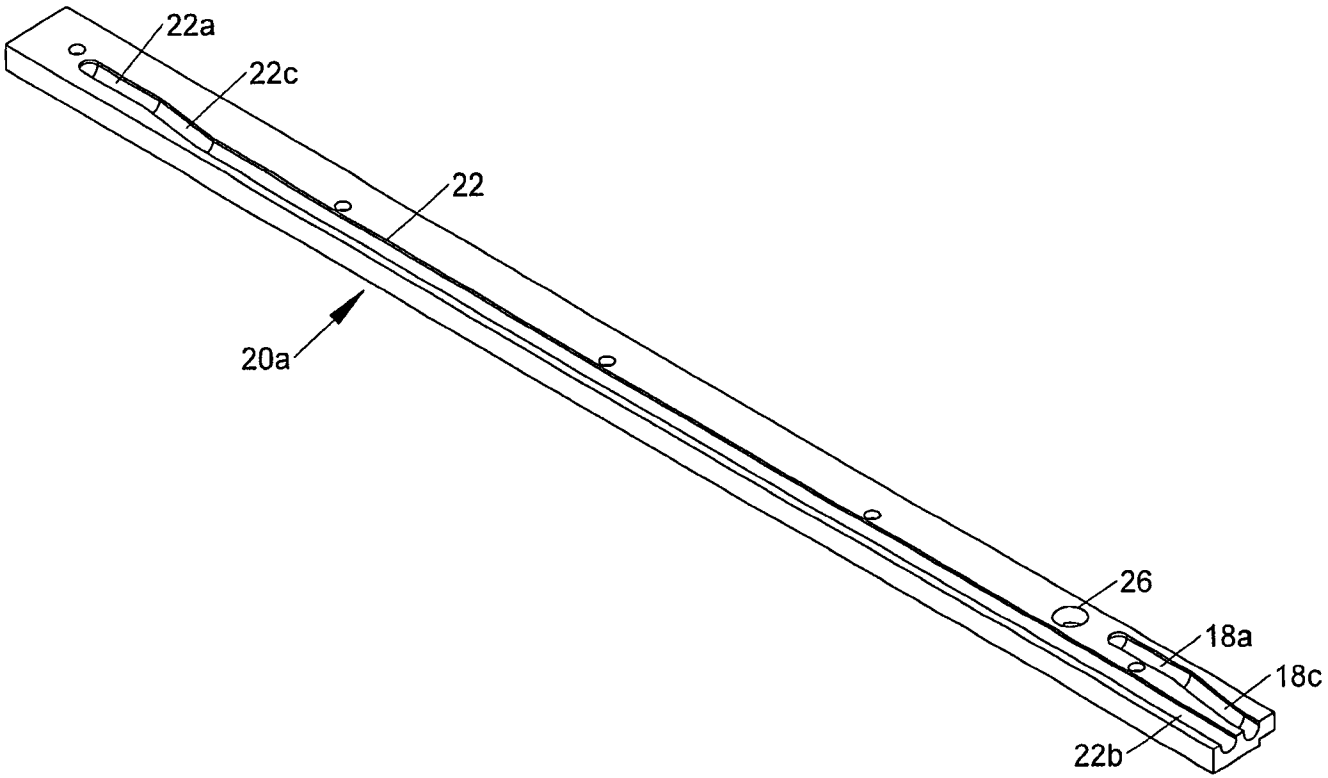
FIG. 9 is, in perspective view, the portion of the lower guide track adjacent the doorframe opening into the bathtub enclosure.
Figure 10C:
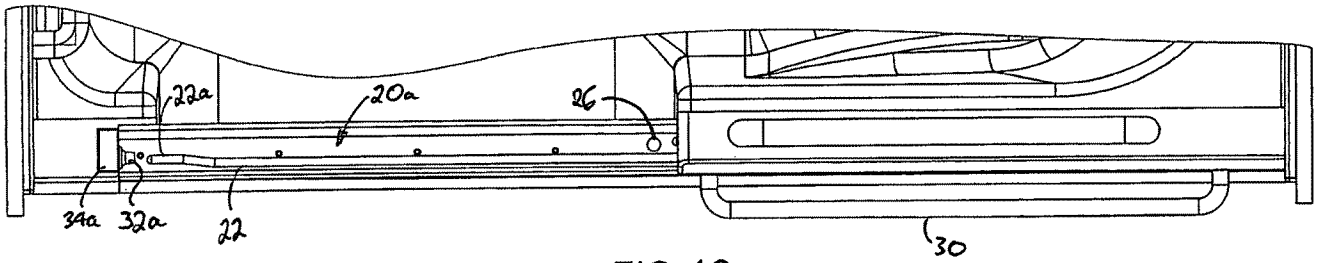
FIGS. 10*a*-10*c* are, in partially cutaway plan view, a sequential progression of the door of FIG. 2*a* in, respectively, a closed position, a partially open position, and a fully open position.
Figure 10B:
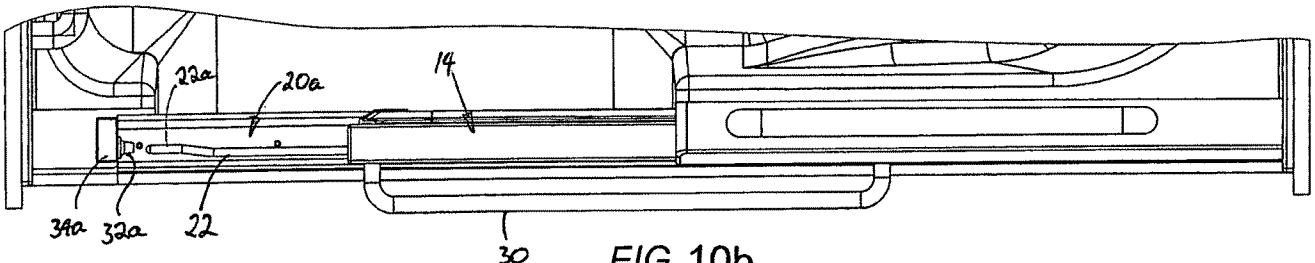
Figure 10A:
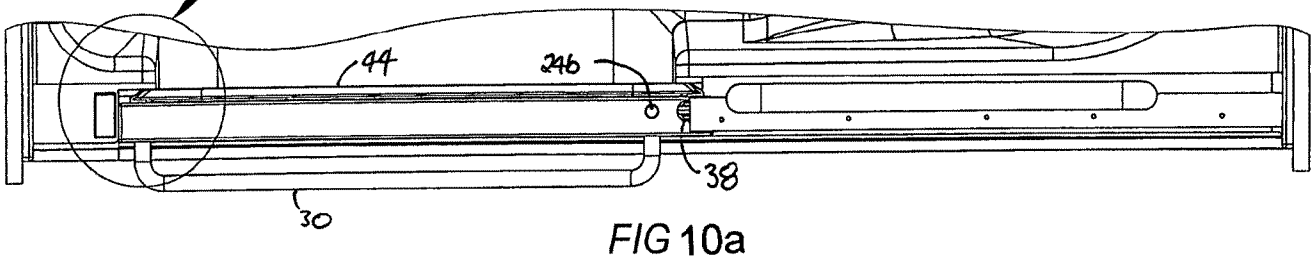
Figure 11:
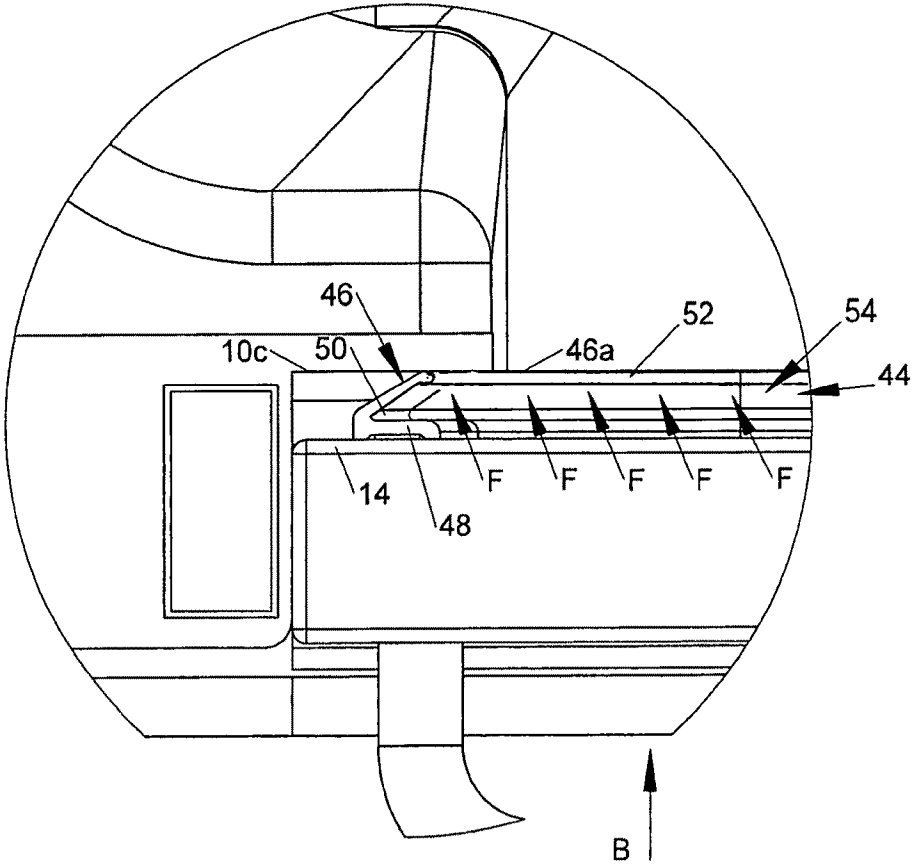
FIG. 11 is, in partially cut away enlarged view, a segment of the door seal sandwiched between the door and doorframe of FIG. 10*a*.

In the accompanying FIGS. 1-11 similar characters of reference denote corresponding parts in each view. As seen in those Figures, a tub 10 has an enclosure 10*d* defined by at least one sidewall 10*a*. The sidewall 10*a* has a doorway or opening 10*b* therein defined by a doorframe 10*c*. A door 14, when closed, provides a watertight seal for the corresponding opening. The door releasably locks into its closed sealed position within the bathtub doorframe opening by translating in direction A into its closed position from its open position parallel to, and along side so as to be adjacent, bathtub sidewall 10*a*. In the embodiment illustrated, which is not intended to be limiting, door 14 is slidably mounted to guides or guide channels 18 and 22 formed in guide channel members 20*a* and 20*b* and translates along the guide channels on guide followers such as so-called caster-style wheels or rollers 16*a* and 16*b*.

Guide channel members 20*a* and 20*b* are aligned longitudinally so as to align the dog-leg end 18*a* with channel 18. Thus, with roller 16*a* mounted in channel 18, and with roller 16*b* mounted in channel 22, door 14 may be translated from its open position with rollers 16*a* and 16*b* in their fully open position in ends 18*b* and 22*b* in channels 18 and 22 respectively, to its closed position with rollers 16*a* and 16*b* parked in the opposite ends 18*a* and 22*a* of channels 18 and 22 respectively. Thus as door 14 translates in direction A rollers 16*a* and 16*b* correspondingly translate along channels 18 and 22, and door 14 transitions from its open position parallel to side 10*a* of bathtub 10 to its closed position inset into opening 10*b* defined by doorframe 10*c*. Rollers 16*a* and 16*b* are diverted from a strictly linear path by dog-leg portions 18*c* and 22*c* of channels 18 and 22. Dog-leg portions 18*c* and 22*c* in guides 18 and 22 define an arcuate path and translate door 14 into the doorframe 10*c* in direction B once the door is aligned with opening 10*b*. The dog-leg portions maintain the door parallel to side wall 10*a* as the door slides in both directions A and B so as to inset the door into doorframe 10*c*.

With door 14 seated within bathtub opening 10*b* and door frame 10*c*, that is, in its closed and sealed position, a lower, vertically aligned pin 24*a* in door 14 aligns vertically over a corresponding aperture 26 in guide channel member 20*a*, adjacent end 18*a* of guide channel 18. Pin 24*a* extends rigidly downwardly and coaxially with a linear locking bar 28. Pin 24*a* together with the locking bar 28 forms a releasable latch which is actuated by a cooperating latch actuator. Locking bar 28 is mounted so as to extend substantially vertically between parallel horizontal upper and lower door members 14*a* and 14*b*. Locking bar 28 is mounted for vertically reciprocating movement in direction C, vertically oppositely disposed pins 24*a* and 24*b* being slidably journalled in corresponding apertures in door members 14*a* and 14*b*.

In one embodiment, the cooperating latch actuator comprises a substantially horizontal first latch member such as a cross bar or lever 30. As shown in the figures, lever 30 is pivotally mounted at its opposite ends 30*a* and 30*b* to the upper ends of vertical door member 14*c* and a second latch member, respectively. In one embodiment, the second latch member is the locking bar 28. Thus end 30*a* may be pivoted in direction D relative to doorframe member 14*c* so as to reciprocate in a substantially vertical trajectory E opposite end 30*b* of cross bar 30, thereby vertically correspondingly reciprocating locking bar 28 in direction C. The locking bar comprises a latch drive arm mounted at a lower end thereof. When a user actuates the lever 30, the latch drive arm slides in and out of a latch member female receiver. In the illustrated embodiments, the latch drive arm is the pin24*a* which slides in and out of the aperture 26.

As door 14 is translated in direction A into its closed position within opening 10*b* and doorframe 10*c*, upper and lower horizontally extending pins 32*a* and 32*b* mounted to, so as to extend horizontally inwardly into opening 10*b* from, doorframe member 34*a*, mate into corresponding apertures 36*a* and 36*b* in vertical door member 14*c*. Pins 32*a* and 32*b* may have, as illustrated, frusto-conically shaped distal ends so as to initially engage and then guide apertures 36*a* and 36*b* into snug mating engagement against the corresponding base portions of pins 32*a* and 32*b* as door 14 translates into its fully seated position and as pin 24*a* comes into alignment with aperture 26.

The upper end of vertical door member 14*d* is maintained in a vertical aspect during translation of the door between its open and closed position, thereby assisting in maintaining the entire door vertical as it translates along the lower dog-legged channels 18 and 22, by an upper guide roller 38. Guide roller 38 is rotatably mounted to the corner of the door formed by the upper end of member 14*d* and the corresponding end of member 14*a*. Guide roller 38 follows along and within an inverted guide track 40. Inverted guide track 40 has a guide channel 42 formed therein which is substantially a mirror image of guide channel 18 in guide channel members 20*a* and 20*b*. Thus, as the lower corner of door 14 supported on roller 16*a* snugs door 14 into its closed position within door opening 10*b* and doorframe 10*c*, guide roller 38 also simultaneously snugs the upper end of door 14 into a correspondingly closed position within door opening 10*b* and door frame 10*c*. In particular, the dogged leg portions of guide channels 18, 22 and 42 draw door 14 along a parallelogram path so that, door 14 is maintained parallel to side 10*a* of bathtub 10 while smoothly bringing passive hydrostatic seal 44 into sealing engagement against doorframe 10*c* as door 14 is translated in direction B into its fully closed and sealed position. In one embodiment, the seal 44 is mounted to the door 14.

Hydrostatic seals 44 are in the preferred embodiment formed by a single unitary U-shaped flexible seal. In cross section the seal is formed so as to be generally concave. As illustrated, the concavity is V-shaped; formed in the acute angle between a pair of substantially planar resilient flanges 46 and 48 respectively which intersect along a single common vertex 50. Vertex 50 is formed along the outside perimeter of the U-shaped seal. Thus the vertex is linear along the two upright portions of the U-shaped seal and also linear along the horizontal bottom portion. The upright portions and bottom portion are contiguous. Although seal 44 is illustrated as having a V-shape concavity, it is understood that the present invention is not so limited in that concavities having different cross sectional shapes will also work. Such other concavities will work so long as the concavity is formed so as to be disposed, that is open, inwardly from around the perimeter of door 14 so that water pressure from water within the tub presses against the inside surface of the concavity in direction F thereby forcing the resilient sides of the concavity outwardly against the door and the surface of doorframe 10*c* so as to increase the sealing of the watertight seal. In other words, the concavity extends substantially around a circumference of the door 14 and corresponding circumference of the doorframe 10*c*. In one embodiment the distal edge 46*a* of resilient flange 46, that is the linear edge cantilevered outermost from vertex 50, is reinforced by a thickened bead 52 running along the length of distal edge 46*a*.

One advantage of using passive hydrostatic seal 44 is to minimize the shearing forces acting on the seal material, that is, as the door snugs finally into its closed position in direction A and the seals partially compress against the doorframe. In applicant's experience, such shearing of for example tubular seals such as found in the prior art degrades the seal over time thereby increasing the risk of water leaking through the seal and escaping from the bathtub. With the use of passive hydrostatic seals 44, door 14 does not form the watertight seal by mere compression, that is, crushing of the seal against the doorframe, but rather the door is positioned merely so as to engage edge 46*a* of resilient flange 46 against the doorframe 10*c* while deliberately leaving concavity 54 open to water pressure acting in direction F. Thus, as door 14 translates along the final portion of closed position ends 18*a* and 22*a* of guide channels 18 and 22 respectively, flange 46 of seal 44 is only dragged over the surface of doorframe 10*c* by a relatively short distance thereby minimizing the build-up of shearing stress applied to seal 44. Once water is filled into the tub so that the water presses in direction F along the length of the seal against the concavity, the seal flanges sandwiched between the door and doorframe are urged outwardly against the door and doorframe.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A bathtub for the disabled or elderly comprising:

a tub having an enclosure defined by at least one sidewall, said sidewall having a doorway therein defined by a doorframe, said doorway providing access from an external side of said sidewall, external to said enclosure, into said enclosure, at least one generally horizontal elongate vertically spaced apart pair of elongate guides in said sidewall, a door slidably mounted to said guides on guide followers mounted to both said door and at least one of said guides for guiding substantially horizontal translation of said door along said sidewall between a closed position wherein said door is releasably lockably mounted within said doorway adjacent said doorframe, and an open position clear of said doorway and substantially parallel to said sidewall, a releasable latch and cooperating latch actuator for releasable latching engagement of said door in said closed position and for releasing said door from such engagement upon actuation of said latch actuator into a release position by a user, a passive hydrostatic seal mounted between said door and said doorframe when said door is in said closed position, wherein said seal is resilient and includes a resilient-walled concavity extending substantially around a circumference of said door and corresponding circumference of said doorframe so as to dispose an elongate opening of said concavity inwardly into said doorway and open to water pressure from water in said enclosure whereby, when said door is in said closed position, the water pressure bears against said seal and urges said concavity to resiliently deform against said doorframe and said door to form a watertight sealed engagement between said door and said doorframe.

2. The bathtub of claim 1 wherein said guides each have an arcuate path and said guide followers are rollers mounted to said door, said rollers rotatably mounted for both rolling along said guides and for rotation about vertical axes of rotation so as to follow said arcuate paths.

3. The bathtub of claim 1 wherein said latch actuator includes at least one substantially horizontal first latch member pivotally mounted to said door and cooperating with a substantially vertical second latch member of said releasable latch for vertical urging of said second latch member into latched engagement with a latch member female receiver in said doorframe so as to releasably engage said door with an edge of said doorway upon closing of said door into said closed position.

4. The bathtub of claim 3 wherein said first latch member is a lever which at a first end is pivotally mounted to said door for reciprocating actuation by the user, and which at its opposite second end is pivotally mounted to said second latch member, and wherein said second latch member includes at least one latch drive arm mounted to said door for reciprocating sliding into and out of releasably latching engagement with said female receiver.

5. The bathtub of claim 4 wherein said lever is horizontal and wherein said at least one latch drive arm is a rigid vertical drive arm mounted at a lower end of said second latch member for the selective driving of a distal lowermost end of said arm into said female receiver, and wherein said female receiver is an aperture in a lower portion of said doorframe.

6. The bathtub of claim 5 wherein said lever is horizontally disposed across an upper portion of said door so as to extend from and lateral side of said door to an opposite lateral side of said door.

7. The bathtub of claim 1 wherein said hydrostatic seal is U-shaped so as to have a bottom portion extending along a lowermost portion of said doorframe and door when in said closed position, and so as to have upright portions extending contiguously upwardly from said bottom portion, the resilient-walled concavity being formed by said bottom portion and upright portions.

8. The bathtub of claim 7 wherein said concavity is, in cross section, substantially V-shaped.

9. The bathtub of claim 8 wherein said seal is mounted to said door.

10. The bathtub of claim 9 wherein said seal has a free edge around a circumference thereof, and wherein said free-edge is reinforced with a bead therealong.

* * * * *